US005933948A

United States Patent [19]

Suemitsu et al.

[11] Patent Number: 5,933,948

[45] Date of Patent: Aug. 10, 1999

[54] METHOD OF MANUFACTURING A RECORDING HEAD FOR ELECTROSTATIC RECORDING

[75] Inventors: Yuji Suemitsu; Koji Masuda; Kazuo Asano; Masashi Ogasawara; Akinori Komura; Takashi Nagao, all of Kanagawa, Japan

[73] Assignee: Fuji Xerox Co., Ltd., Tokyo, Japan

[21] Appl. No.: 08/695,539

[22] Filed: Aug. 12, 1996

Related U.S. Application Data

[62] Division of application No. 08/123,265, Sep. 20, 1993, abandoned.

[30] Foreign Application Priority Data

Sep. 21, 1992 [JP] Japan ..... 4-251547

[51] Int. Cl.[6] ..... H01K 3/22

[52] U.S. Cl. ..... 29/851; 29/846; 29/885

[58] Field of Search ..... 29/846, 851, 885; 156/89

[56] References Cited

U.S. PATENT DOCUMENTS

| | | | |
|---|---|---|---|
| 4,160,257 | 7/1979 | Carrish | 347/127 |
| 4,408,214 | 10/1983 | Fotland et al. | 347/128 |
| 5,170,189 | 12/1992 | Masuda et al. | 347/127 |
| 5,187,595 | 2/1993 | Kitani et al. | 358/482 |

*Primary Examiner*—P. W. Echols
*Attorney, Agent, or Firm*—Finnegan, Henderson, Farabow, Garrett & Dunner, L.L.P.

[57] ABSTRACT

The present invention provides a recording head for electrostatic recording having a plurality of lower electrodes and a plurality of upper electrodes constituting a matrix with an insulating layer interposed therebetween and a space for ion generation where corona discharge is caused by applying a voltage between the lower and upper electrodes characterized in that a plurality of short partial recording heads are formed by integrally firing the lower electrodes, insulating layer and upper electrodes and are joined to provide a recording head of a desired length.

3 Claims, 15 Drawing Sheets

METHOD OF MANUFACTURING A RECORDING HEAD FOR ELECTROSTATIC RECORDING

This is a division of application of application Ser. No. 08/123,265, filed Sep. 20, 1993 now abandoned.

BACKGROUND OF THE INVENTION

1. Field of the Invention

The present invention relates to a recording head for electrostatic recording which forms an electrostatic latent image by modulating ion currents and selectively introducing ions into a dielectric substance and to a manufacturing method thereof.

2. Discussion of the Related Art

An electrostatic recording apparatus uses a recording head capable of modulating ion currents corresponding to each picture element to form an electrostatic latent image of a desired pattern on a dielectric substance. For example, U.S. Pat. No. 4,408,214 discloses the construction of a recording head in which a matrix is constituted by an intersecting plurality of drive electrodes and plurality of control electrodes with an interposed insulating layer to form an electrostatic latent image corresponding to picture elements.

Japanese Patent Application Unexamined Publication No. Hei. 3-109585 (1991) discloses another example: an electrostatic recording apparatus using a recording head in which an insulating layer between electrodes is made of a ceramic material.

In the above recording apparatus disclosed by the Japanese Patent Application Unexamined Publication, as shown in FIG. 16, a recording head 101 disposed facing the surface of a dielectric drum 103 forms an electrostatic latent image on the dielectric drum 103 in accordance with an image signal. The electrostatic latent image is developed by a developing device 102, and then transferred and fused by a pressure roller 107 to a recording medium 106 such as recording paper, thus recording the image. Developer remaining on the dielectric drum 103 after transfer is removed by a cleaning device 104 and residual toner on the dielectric drum 103 is removed by a discharging device 105.

The recording head 101 has a plurality of ion emission ports each of them corresponding to one picture element. FIG. 17 is a cross-sectional view showing the ion emission port for one picture element. FIG. 18 is a plan view showing the whole recording head 101 except a screen electrode.

In the recording head 101, plural lower electrodes 2-1, 2-2, and so on (hereafter, generically referred to as the lower electrodes 2) are arranged parallel to each other on a substrate 1, and forked upper electrodes 4-1, 4-2, and so on (generically referred to as the upper electrodes 4) are arranged on and crossing the lower electrodes 2 with a lower insulating layer 3 between, thus the lower electrodes 2 and upper electrodes 4 constitute a matrix. In the example shown in FIG. 18, the number of the lower electrodes arranged on the substrate is n.

The upper electrodes 4 have apertures 4*a* at the point of intersection with the lower electrodes 2, and a screen electrode 22 is mounted on an insulating layer 10 on the upper electrodes 4. The insulating layer 10 and screen electrode 22 have apertures 10*a* and 22*a*, respectively, at the points corresponding to the apertures 4*a* in the upper electrodes 4.

As shown in FIG. 17, the above-described recording head 101 selectively applies a high voltage of high frequency $V_B$ between the lower electrodes 2 and screen electrode 22, and applies an ion control voltage $V_C$ to the upper electrodes 4, and a DC voltage $V_A$ to the screen electrode 22, respectively.

Consequently, creeping corona discharge is generated between the lower electrodes 2 and upper electrodes 4 corresponding to a matrix to which the high voltage of high frequency is applied, and ions generated by the creeping corona discharge are accelerated or absorbed by the electric field between the upper electrodes 4 and the screen electrode 22 to control ion emission to obtain the electrostatic latent image.

The recording head 101 described above is made, for example, by the following print-lamination method.

First of all, the lower electrodes 2 which function as drive electrodes are formed by screen printing or the like on a substrate 1 of a material called green sheet which can be hardened by firing, and the lower insulating layer 3 made of the green sheet is formed by screen printing or the like on the substrate on which the lower electrodes 2 are already formed. The upper electrodes 4 which function as control electrodes are formed on the lower insulating layer 3 by screen printing or the like, and the upper insulating layer 5 is formed thereon by screen printing or the like. After that the green sheet, upper and lower electrodes and insulating layers are fired. The green sheet material will be described in detail later.

However, the above-described method for making a recording head has a problem that because the green sheet material and electrodes in layers contract when fired, the dimensions of the recording head after firing are reduced. To obtain a recording head of the desired dimensions after firing, the electrodes and so forth are printed taking the contraction rate into account, but it is still difficult to obtain the head of desired dimensions after firing because of the wide variation of the contraction rate approximately ranging from 12 to 20%.

A conventional method for manufacturing a recording head completes the recording head by fitting the screen electrode 22 after firing. When fitting the screen electrode, a large offset between the positions of the aperture 22*a* of the screen electrode 22 and the ion emission port consisting of apertures 4*a* and 10*a* causes a reduction of the output and results in deterioration of the recorded image density, unevenness or blurring of the image. It is preferable that the offset is not more than one half of the recording resolution, for example, 50 $\mu$m or less for 240 dpi, and 40 $\mu$m or less for 300 dpi. However, because the contraction rate of the recording head caused by firing is considerable, approximately ranging from 12 to 20%, it is difficult to restrict the offset to one half or less of the recording resolution.

SUMMARY OF THE INVENTION

The present invention has been made in view of the above circumstances and has as an object to overcome the problems described above.

A further object of the present invention is to provide a recording head for electrostatic recording and a manufacturing method thereof wherein the contraction rate of the recording head caused by firing is low.

Additional objects and advantages of the invention will be set forth in part in the description which follows and in part will be obvious from the description, or may be learned by practice of the invention.

To achieve the objects and in accordance with the purpose of the invention, as embodied and broadly described herein, the recording head for electrostatic recording, having a plurality of lower electrodes and a plurality of upper electrodes constituting a matrix with an insulating layer interposed therebetween and a space for ion generation where corona discharge is caused by applying a voltage between the lower and upper electrodes, of this invention is characterized in that a plurality of short partial recording heads are formed by integrating the lower electrodes, insulating layer and upper electrodes for firing, and are joined to provide a recording head of a desired length. The method for manufacturing a recording head for electrostatic recording, having a plurality of lower electrodes and a plurality of upper electrodes constituting a matrix with an insulating layer interposed therebetween and causing corona discharge by applying a voltage between the lower and upper electrodes, of this invention comprises the steps of printing the lower electrodes on a substrate except for both end portions in the longitudinal direction, printing the insulating layer on the lower electrodes, printing the upper electrodes on the insulating layer, forming a plurality of short partial recording heads by integrating the laminated lower electrodes by firing, insulating layer and upper electrodes, forming cut portions at both ends of a cut end line of the plurality of short partial recording heads, removing both end portions in the longitudinal direction of the short partial recording heads where the lower and upper electrodes and insulating layer are not printed, and joining the short partial recording heads at their cut ends to provide a recording head of a desired length.

If the electrodes are printed before firing, as shown in FIG. 1, the body of the recording head on which the electrodes are printed is put on a mounting 11 and fired, whereupon contraction occurs. The contraction rate differs in different positions: generally, the contraction rate is high at both end portions and low in the center portion.

The graph in FIG. 2 shows the relationship between the offset between the positions of the aperture 22*a* of the screen electrode 22 and the ion emission port and length of the head. The shorter the head is, the smaller the offset becomes, and on the other hand, the longer the head is, the larger the offset becomes. In addition, as described above, the contraction rate is relatively high at both end portions, and accordingly the offset can be made satisfactorily low if the electrodes are printed on a large green sheet and then the head is cut from the green sheet.

In the graph, the firing condition A indicates the conventional method for manufacturing a recording head, in which the upper electrode is printed extending over almost the entire surface of the green sheet and then fired. The firing condition B indicates a recording head manufacturing method according to the present invention in which the upper electrode is only printed on the center portion of the green sheet and the other parts are cut off after firing. The graph shows that if the electrodes are printed on the large sized green sheet and the length of the head portion is 125 mm or less, the offset is 50 $\mu$m or less which does not cause any problems.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE PREFERRED EMBODIMENT

Preferred embodiments of a recording head for electrostatic recording and method for manufacturing thereof are now described in detail based on the drawings.

First Embodiment

Figure 1:
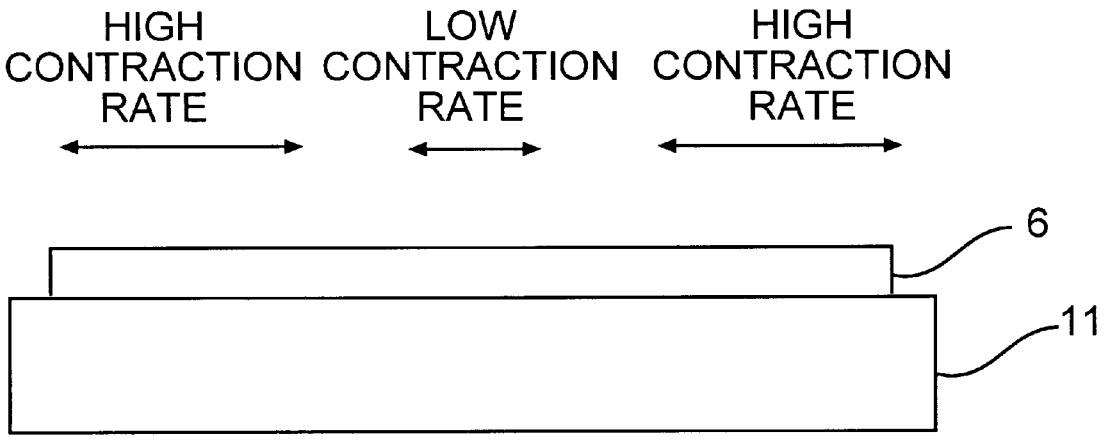
FIG. 1 shows differences in the contraction rate in different portions of the green sheet during the firing process.
Figure 2:
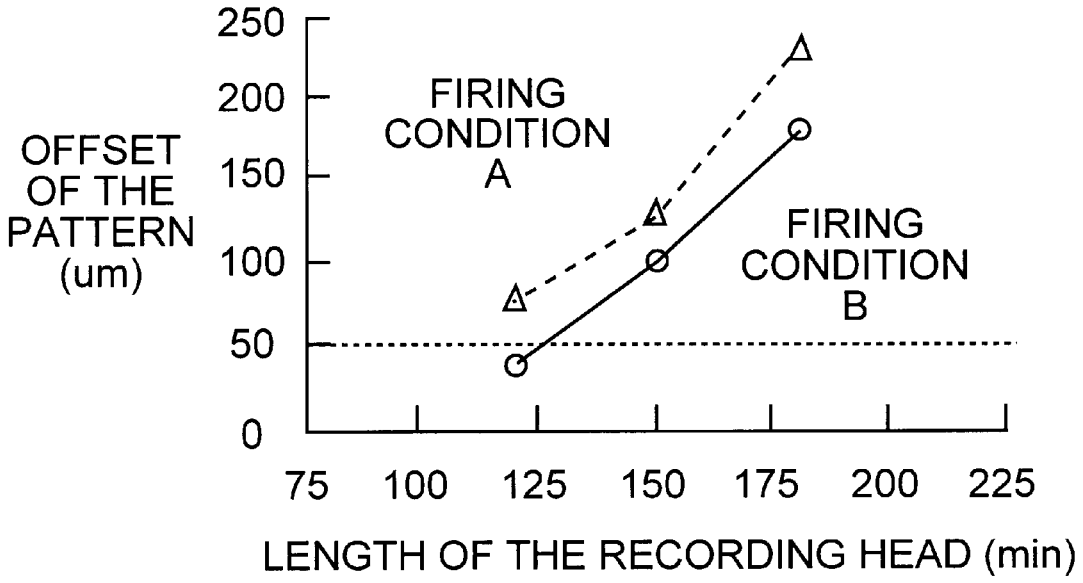
FIG. 2 is a graph indicating the relationship between the offset of the pattern of the upper electrode on the recording head and the length of the recording head.
Figure 3:
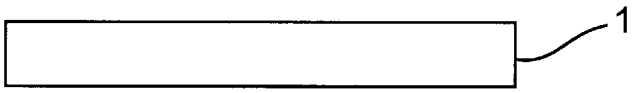
FIGS. 3(*a*) through 3(*f*) show an example method of manufacturing the recording head according to the present invention.
Figure 3:
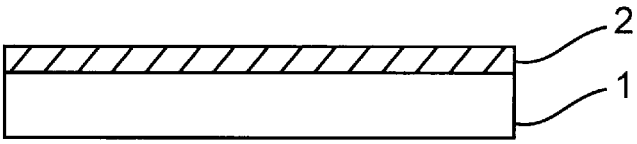
Figure 3:
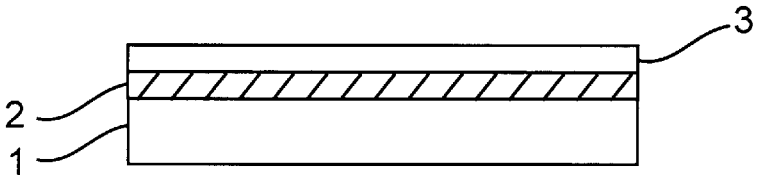
Figure 3:
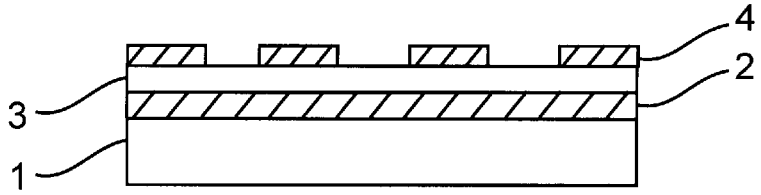
Figure 3:
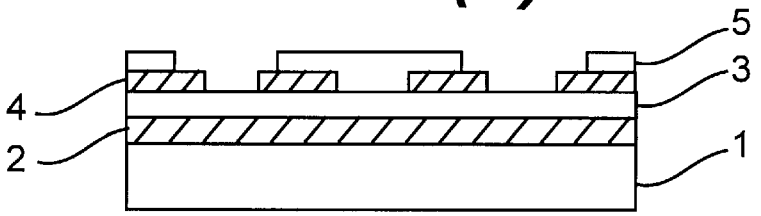
Figure 3:
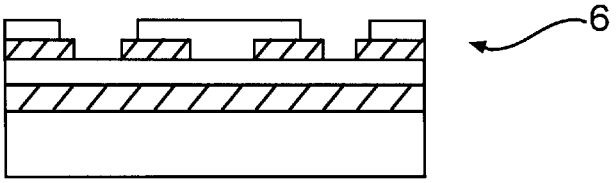
Figure 18:
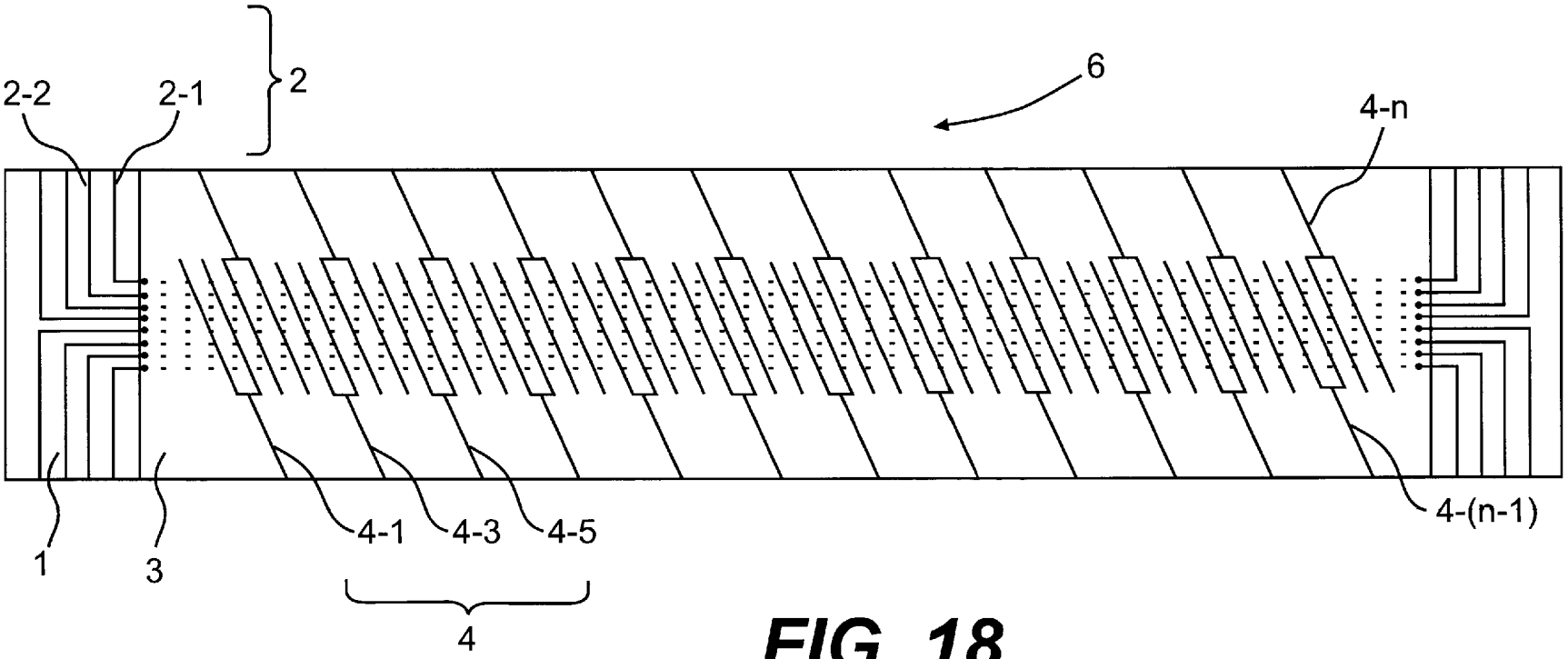
FIG. 18 (PRIOR ART)
FIG. 18 is a plan view of a whole conventional recording head.

This embodiment shows an example of manufacturing a recording head having the same recording width and the same number of picture elements as those of the conventional recording head shown in FIG. 18. In this embodiment, the recording head is divided into two parts and they are separately formed, fired and finally incorporated into one recording head. FIGS. 3(*a*) through 3(*f*) show a method for manufacturing the recording head according to the present invention.

The recording head is manufactured as follows: a substrate 1 is made of the green sheet material (See FIG. 3(*a*)). If the required length of the whole recording head after firing is 180 mm, for example, a green sheet of 50 mm width, 225 mm length and 1 mm thickness, made of 96% purity alumina may be used. Ceramic materials such as alumina and zirconia are principally used as the green sheet. For example, alumina ($Al_2O_3$) powder to which a firing assisting agent such as $SiO_2$, Mg, O, CaO, organic binder, plasticizer or dispersant are added may be used. The green sheet material is shaped by a press method, by a roller method, or by a blade method or the like.

Figure 4:
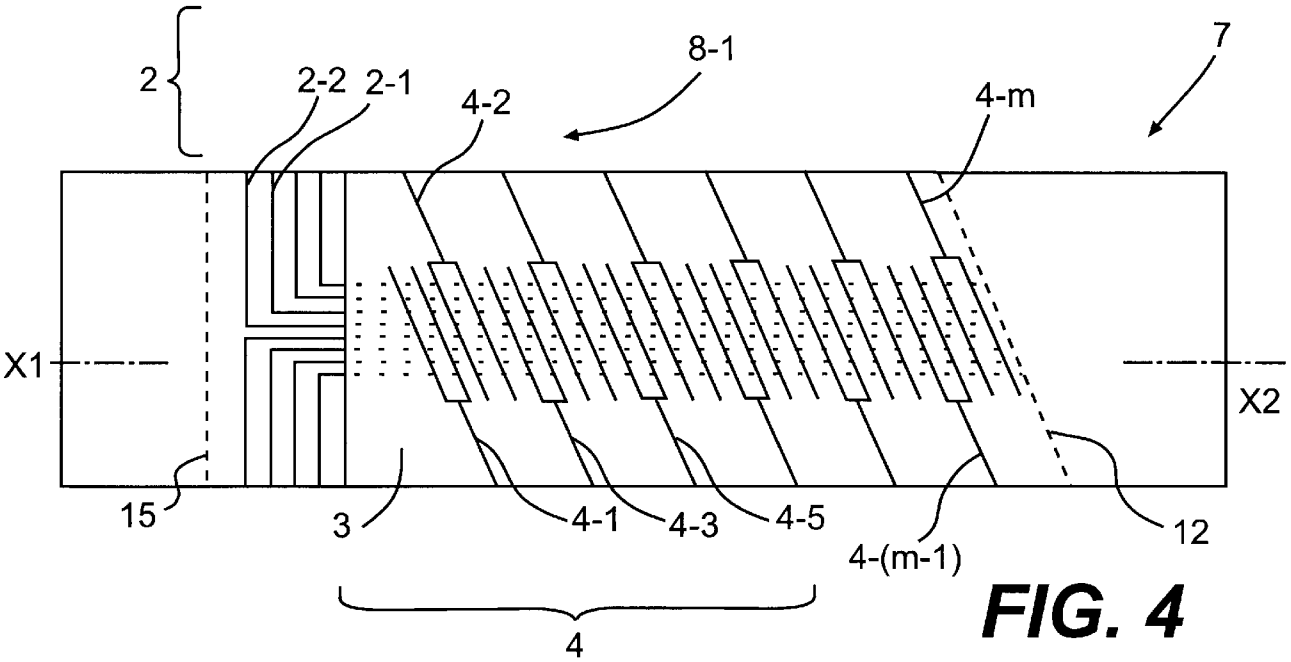
FIG. 4 is a plan view of a main part of a short recording head before cutting out, as used in the present invention.

Next, the lower electrodes 2 which function as drive electrodes are formed by a screen printing method which prints a conductive paste consisting of tungsten for example in a predetermined pattern on the green sheet material constituting a relatively thick substrate 1 formed as described above (See FIG. 3(*b*)). As shown in FIG. 4, the lower electrode 2, for example of 200 μm width and 20 μm thickness, is formed on the substrate 1 except for both end portions in the longitudinal direction of the substrate 1. As the electrode material, a sintered metal conductor such as tungsten (W), molybdenum (Mo), tungsten-manganese (W—Mn), or molybdenum manganese (Mo—Mn) may be used.

The lower insulating layer 3 of, for example, 30 μm thickness is formed by a screen printing method which prints an insulating alumina paste made of the same material as that of the green sheet but of a controlled viscosity in a predetermined shape on the lower electrode 2 on the green sheet (See FIG. 3(*c*)).

The upper electrodes 4 which function as control electrodes are formed by a screen printing method which prints the conductor paste consisting of tungsten for example in a predetermined pattern on the alumina paste constituting the lower insulating layer 3 formed as described above (See FIG. 3(*d*)). The upper electrodes 4 are also formed except for the two end portions in the longitudinal direction of the substrate 1. These upper electrodes 4 are formed so that the spacing of the forked portion is 200 μm and the thickness is 20 μm, and the spacing between the upper electrodes 4 adjacent to each other is about 0.5 mm after firing.

Next, the upper insulating layer of, for example, 20 μm thickness, is formed by a screen printing method which prints an insulating alumina paste made of the same material as that of the green sheet material but of a controlled viscosity in a predetermined shape on the lower electrode 2 on the green sheet (See FIG. 3(*e*)). The layers formed as described above are combined by pressure by applying a predetermined pressure and are fired in a reducing furnace in the temperature range from 1500 to 1600° C., thus integrally forming the substrate 1, lower electrodes 2, lower insulating layer 3, upper electrodes 4 and upper insulating layer 5 in a predetermined shape. The green sheet material constituting the substrate 1 for example contracts about 20% of the above-described dimensions as a result of firing; therefore a recording head of the desired length can be obtained (See FIG. 3(*f*)).

As described above, the lower electrodes 2 and upper electrodes 4 form a matrix. The example of the conventional recording head shown in FIG. 18 forms the lower electrodes 2 and upper electrodes 4 so that the entire matrix is formed on the substrate 1, but in this embodiment, complementary halves of the matrix are printed on the green sheet (180 mm long after firing) which is larger than the part of the recording head (125 mm long after firing), as shown in FIG. 4 and then fired. That is, the length of the lower electrodes 2 in the longitudinal direction is half of that of the conventional recording head and the number of upper electrodes 4 m is one half of the number of upper electrodes of the conventional recording head n.

Figure 5:
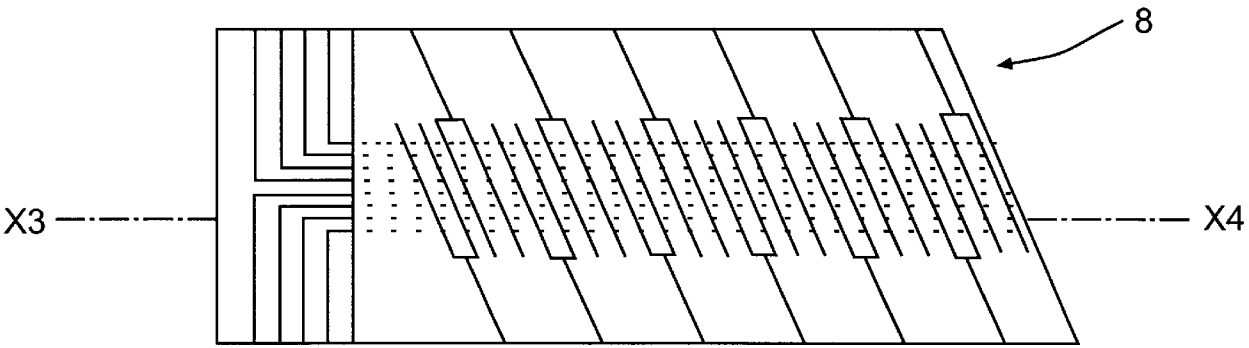
FIG. 5 is a plan view of a main part of a short recording head after cutting out, as used in the present invention.

Next, the short recording head 7 in FIG. 4 is cut off along cut end lines 12 and 15 to obtain the short recording head 8 shown in FIG. 5. The cut end line 12 of the short recording head 8 at the opposite end to the lead-out end of the lower electrodes 2 (in the right side in FIG. 4) must be inside of the center line of the adjacent upper electrodes so that the spacing between the right end upper electrode of the short recording head 8 and the corresponding left end upper electrode of the matching short recording head will be the same as the spacing between the other upper electrodes when the short recording head 8 and another one are abutted in a subsequent process.

Figure 6:
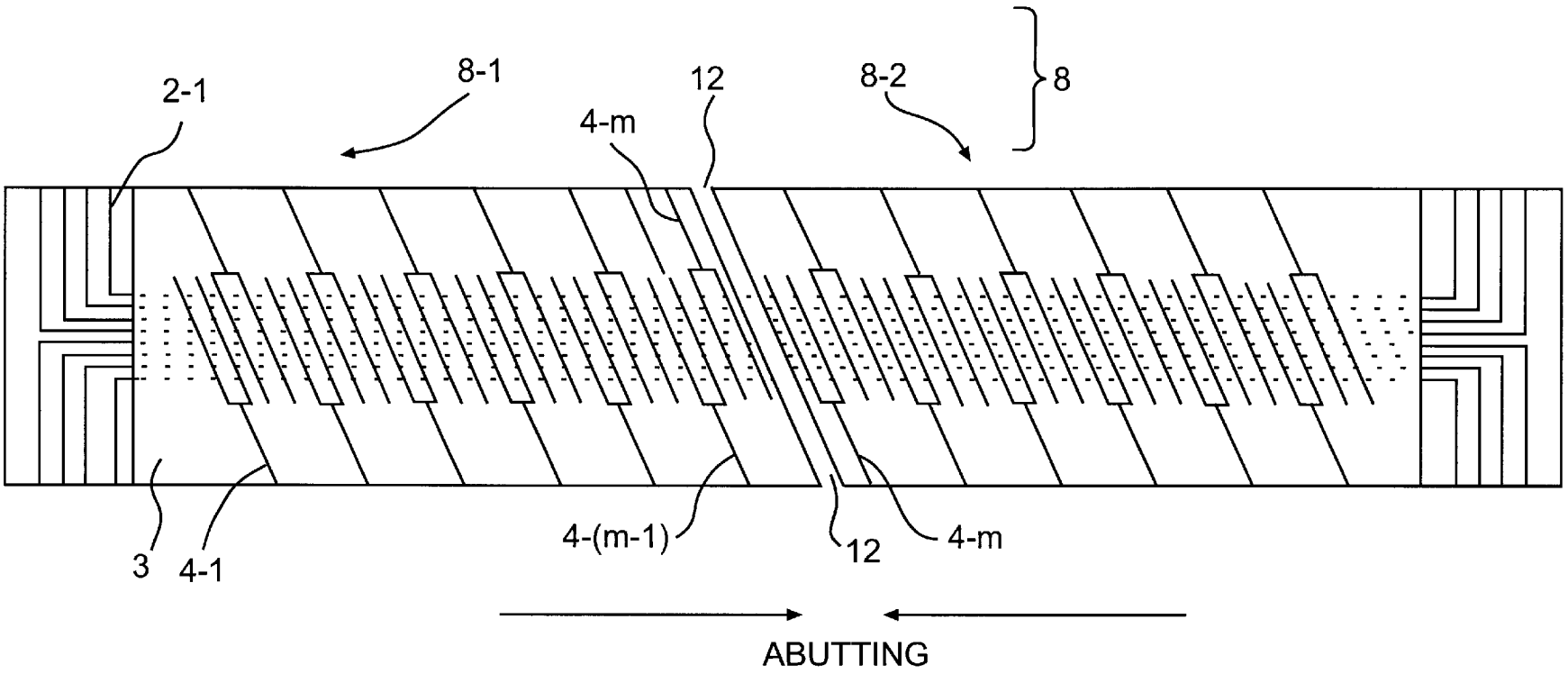
FIG. 6 is a plan view of two abutted short recording heads.

Two short recording heads formed in the process described above are abutted at their cut end lines 12, as shown in FIG. 6, to obtain one integral recording head. It is required to fix these pieces in a precise position so that both of the upper electrodes 4 m in abutting portions are parallel to each other and have a predetermined spacing therebetween.

Figure 7:
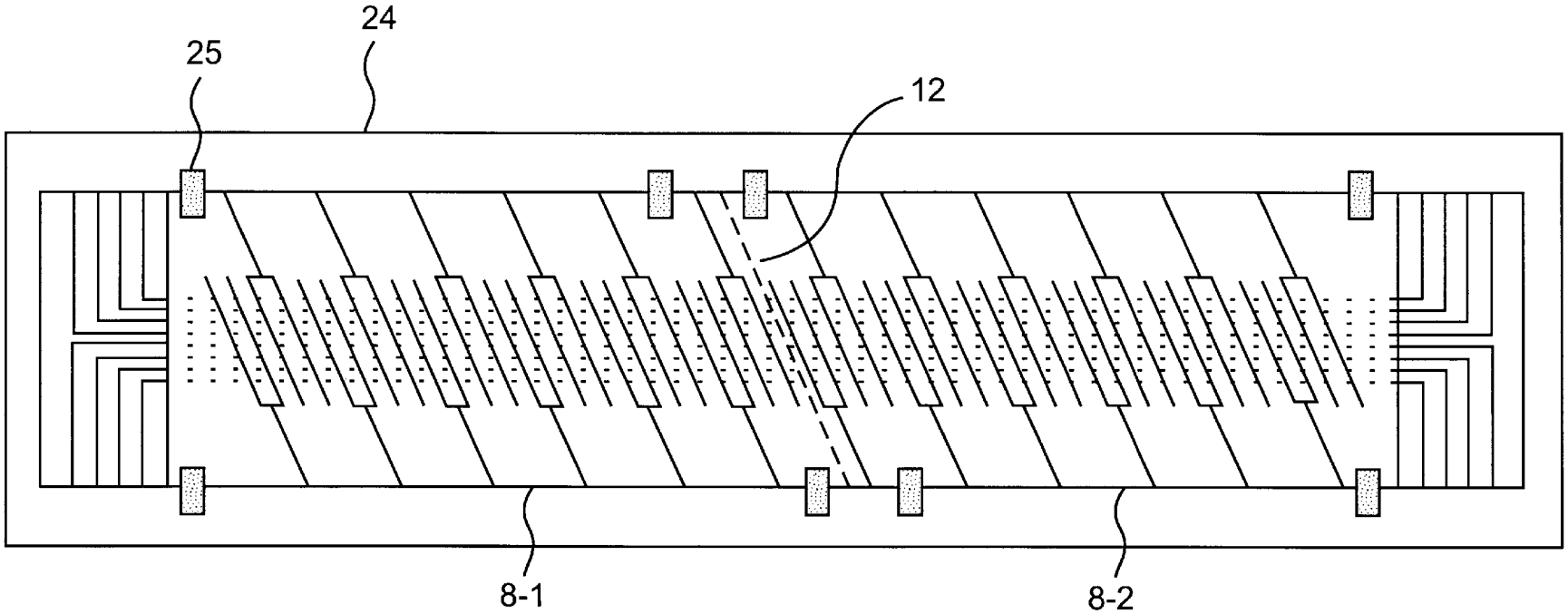
FIG. 7 is a plan view of two short recording heads fixed to a support substrate.

FIG. 7 shows an example of the fixture assembly where two short recording heads 8-1 and 8-2 are disposed abutting each other on a support substrate 24 made of a metal such as SUS303, SUS304 (where "SUS" codes are codes for types of stainless steel prescribed by JIS), nickel-plated iron, or aluminium, or ceramics such as alumina, and fixed by fixing claws 25, thus being incorporated into one recording head. The fixing means is not limited to a claw means. For example, adhesive or a combination of adhesive and fixing members may be adopted, and moreover there is no limitation to the materials of the fixing means.

It is required to accurately cut along the cut end line 12 for precise fixing of two short recording heads as described above.

Several methods for accurately cutting along the cut end line are now described.

Figure 8A:
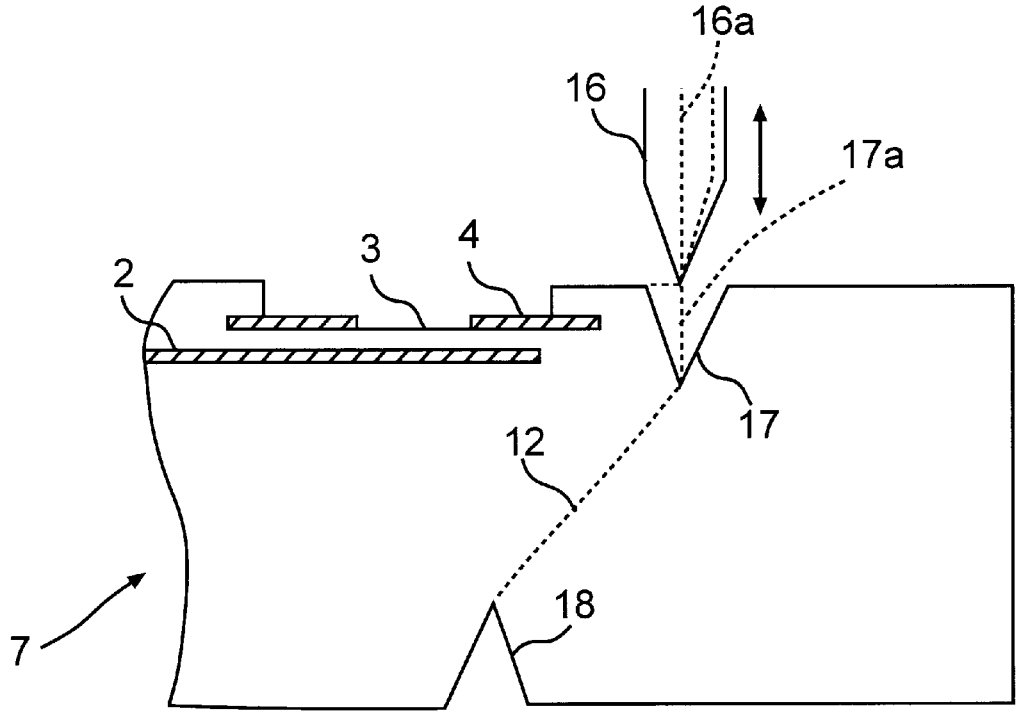
FIGS. 8(*a*) and 8(*b*) are partial cross-sectional views showing one example method for cutting out the main part of the short recording head.
Figure 8B:
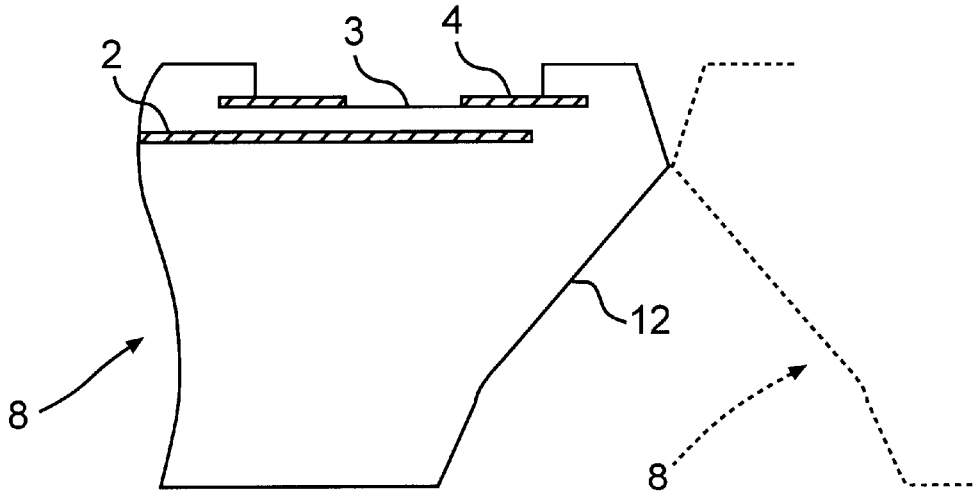

FIG. 8(*a*) is a cross-sectional view showing a portion around the cut end line 12 of the short recording head 7 along the line X1–X2 before cutting and FIG. 8(*b*) is a cross-sectional view showing a portion around the cut end line 12 of the short recording head 8 along the line X3-X4 after cutting. The short recording head 7 before cutting has a first cut portion 17 and a second cut portion 18 which are approximately V-shaped in cross section. The second cut portion 18 on the underside of the short recording head is formed more closely to the lead-out end of the electrodes (left side in FIG. 8(*a*)) than the first cutting portion 17 on the face on which the electrodes are printed. These cut portions 17 and 18 are easily formed by pressing a blade 16 on the green sheet before firing. To prevent the printed electrodes from being pressed and moved when the first cut portion 17 is formed on the face where the electrodes are printed, it is preferable to use a single edged blade 16*a* (indicated by a broken line), which is pressed on the short recording head with its edge facing the portion of the short recording head to be discarded. 17*a* indicates the first cut portion formed by the single edged blade 16*a*.

If an external force is applied to the cut end line 12 after firing, the short recording head is cut along a broken end line 21 between the first cut portion 17 and second cut portion 18. FIG. 8(*b*) is the cross-sectional view showing an end portion of the short recording head 8 after cutting. In this embodiment, since the second cut portion 18 is formed away from the first cut portion 17, the spacing between the electrodes at the abutting portions when two short recording heads 8 are abutted as indicated by a broken line is determined by the shape of the first cut portion 17 and is maintained constant.

Figure 9A:
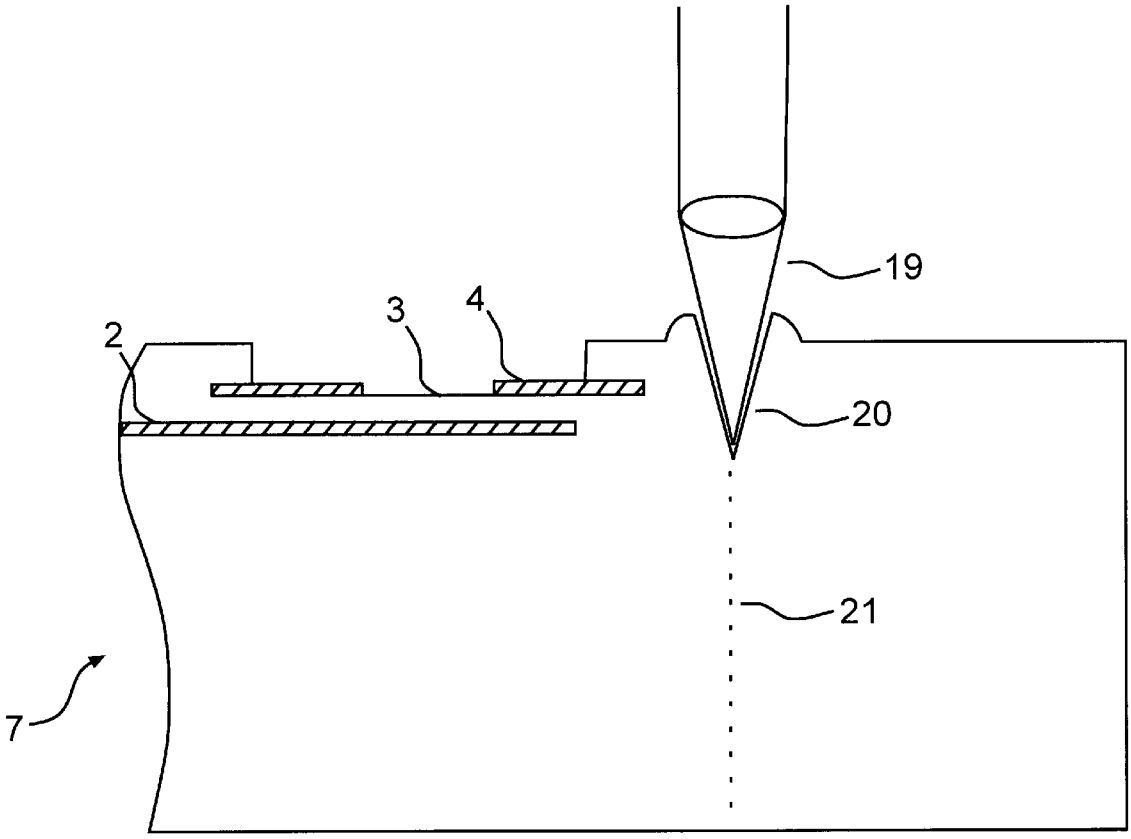
FIGS. 9(*a*) and 9(*b*) are partial cross-sectional views showing another example of method for cutting out the main part of the short recording head.
Figure 9B:
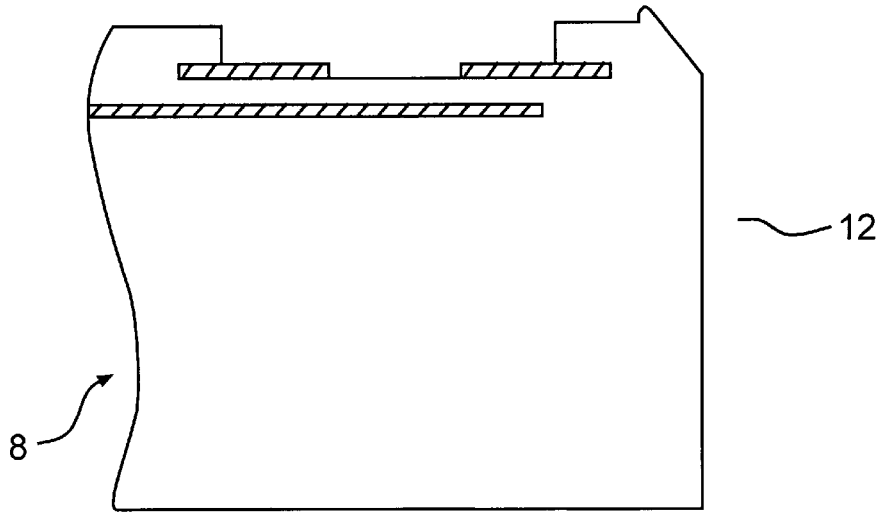

FIGS. 9(*a*) and 9(*b*) show another example of a method for cutting out the short recording head. A cut portion 20 is formed by a laser beam 19 on the cut end line 12 of the short recording head 7 and an external breaking force is applied to the short recording head 7 to cut it. Since edges of the cut portion 20 melt and swell up when formed, it is preferable to form the cut portion 20 only on the front surface of the short recording head 7 considering that it will be stuck on the substrate.

Figure 10:
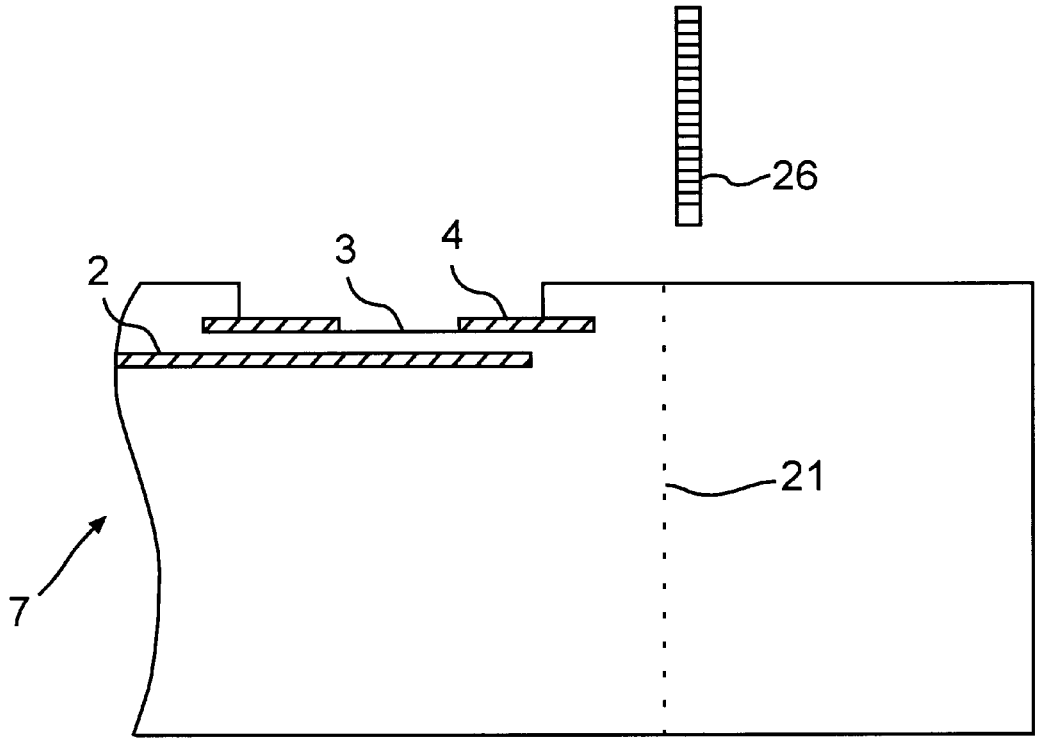
FIGS. 10(*a*) and 10(*b*) are partial cross-sectional views showing a further example method of cutting out the main part of the short recording head.
Figure 10:
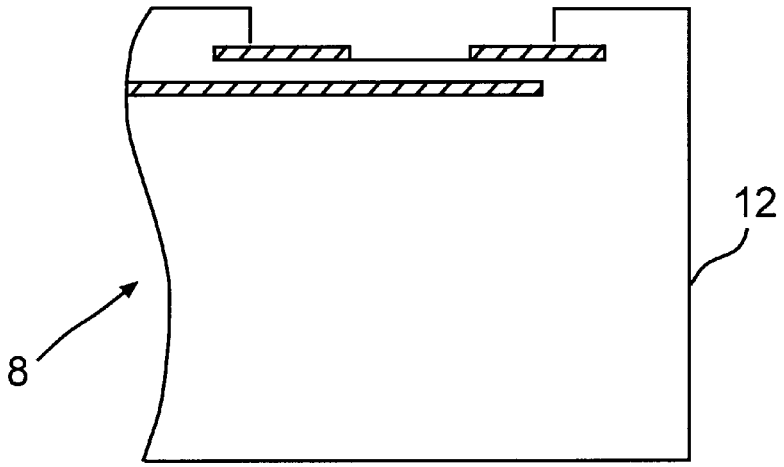

FIGS. 10(*a*) and 10(*b*) show another method for cutting out the short recording head which uses a dicing saw 26 using diamond powder, for example, to cut the short recording head 7 at an appropriate position after firing. FIGS. 10(*a*) and 10(*b*) are cross-sectional views showing the short recording head before and after cutting, respectively.

In the embodiment described above, since the end portions of the lower electrodes 2 and upper electrodes 4 are arranged at some spacing from the cut end line 12, neither the lower electrodes 2 nor upper electrodes 4 are exposed in the section along the cut end line 12 after cutting; therefore there is no possibility of spurious discharges such as a discharge between the lower electrodes 2 and upper electrodes 4 or a discharge among the lower electrodes 2. Consequently, the coating process which is described in detail later can be omitted and the recording head can be manufactured at low cost.

However, in some cases the lower electrodes 2 may be exposed in the section along the end line 12 after cutting, depending on the cutting position or arrangement of the lower electrodes 2, and there is a possibility of a discharge occurring between the lower electrodes 2 and upper electrodes 4, or among the lower electrodes 2. Such anomalous discharge might damage the recording head, and accordingly the embodiment described below contains a preventive measure for such anomalous discharges.

Second Embodiment

Figure 11:
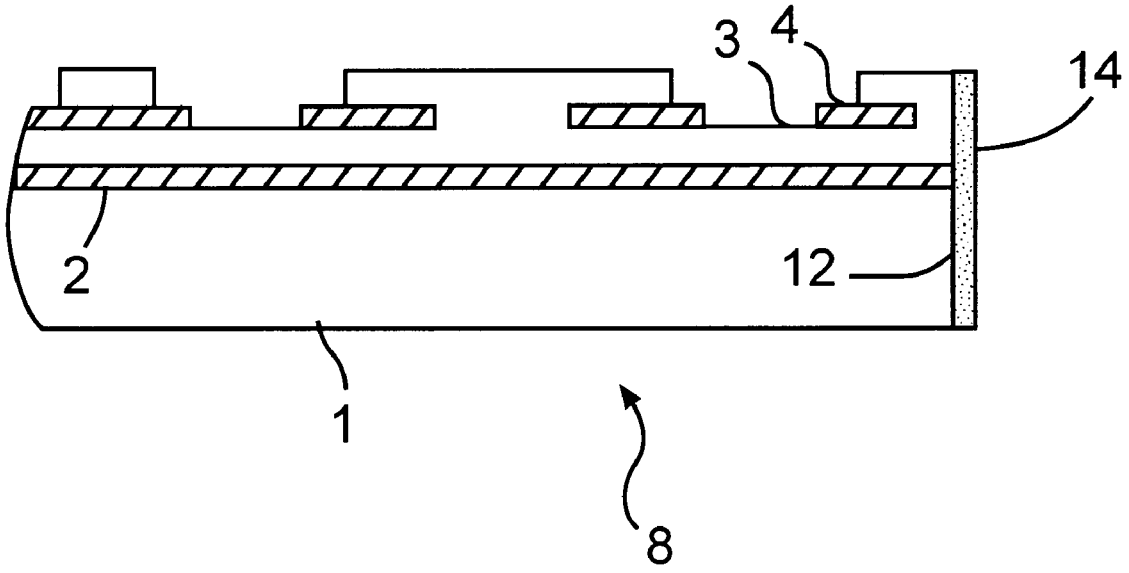
FIG. 11 is a partial cross-sectional view showing an example of the short recording head which has a covering portion to cover a cut portion where electrodes are exposed.

FIG. 11 is a cross-sectional view showing an embodiment which has a sealing portion 14 to cover the section cut along the cut end line 12 where the lower electrodes 2 are exposed. Epoxy resin, for example, is used as the material of the sealing portion.

As described above, the short recording head is cut and two short recording heads are abutted and joined, and then the screen electrode 22 is installed, thus completing the recording head.

Figure 12:
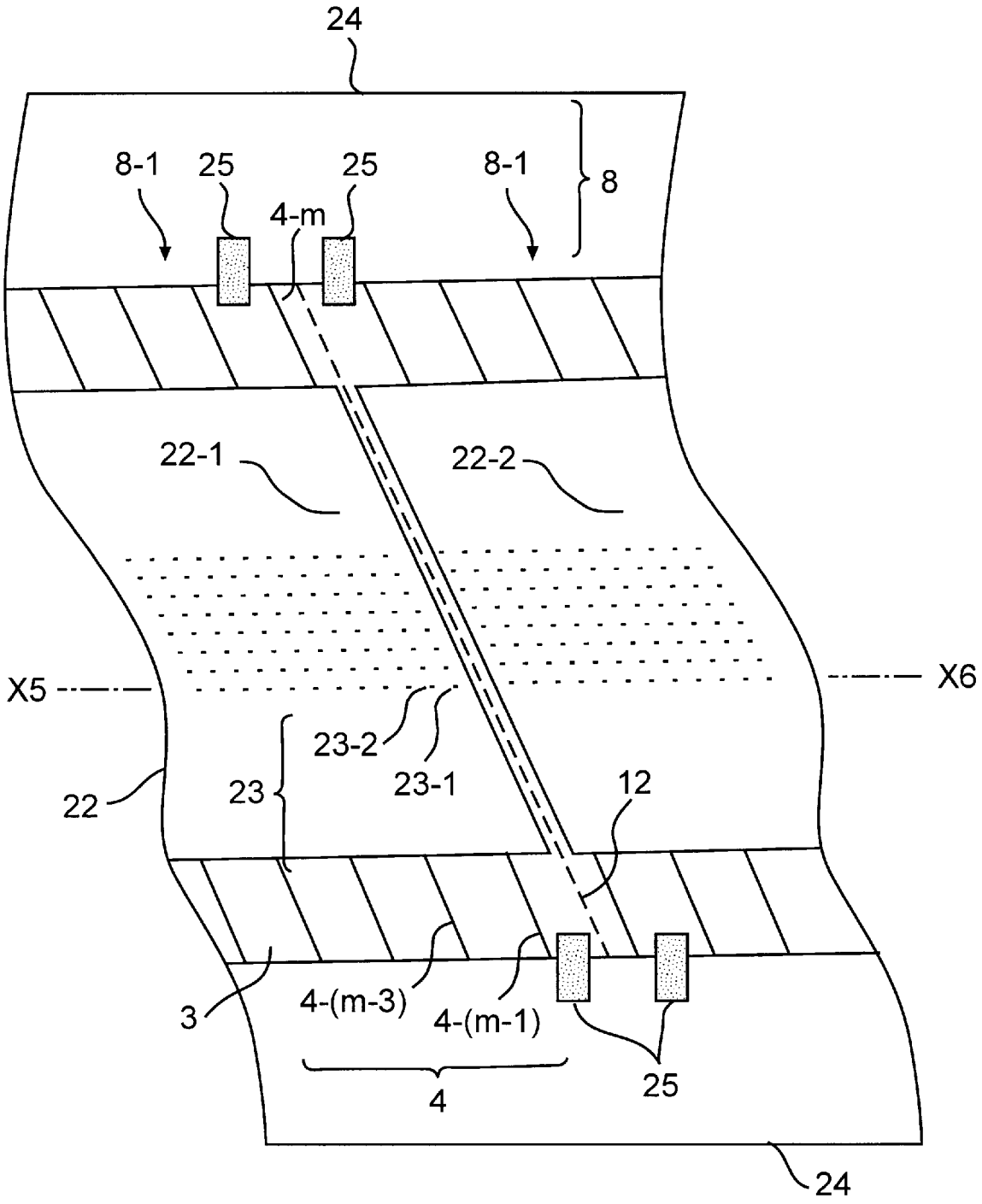
FIG. 12 is a plan view of a recording head using separate screen electrodes for each short recording head.
Figure 13:
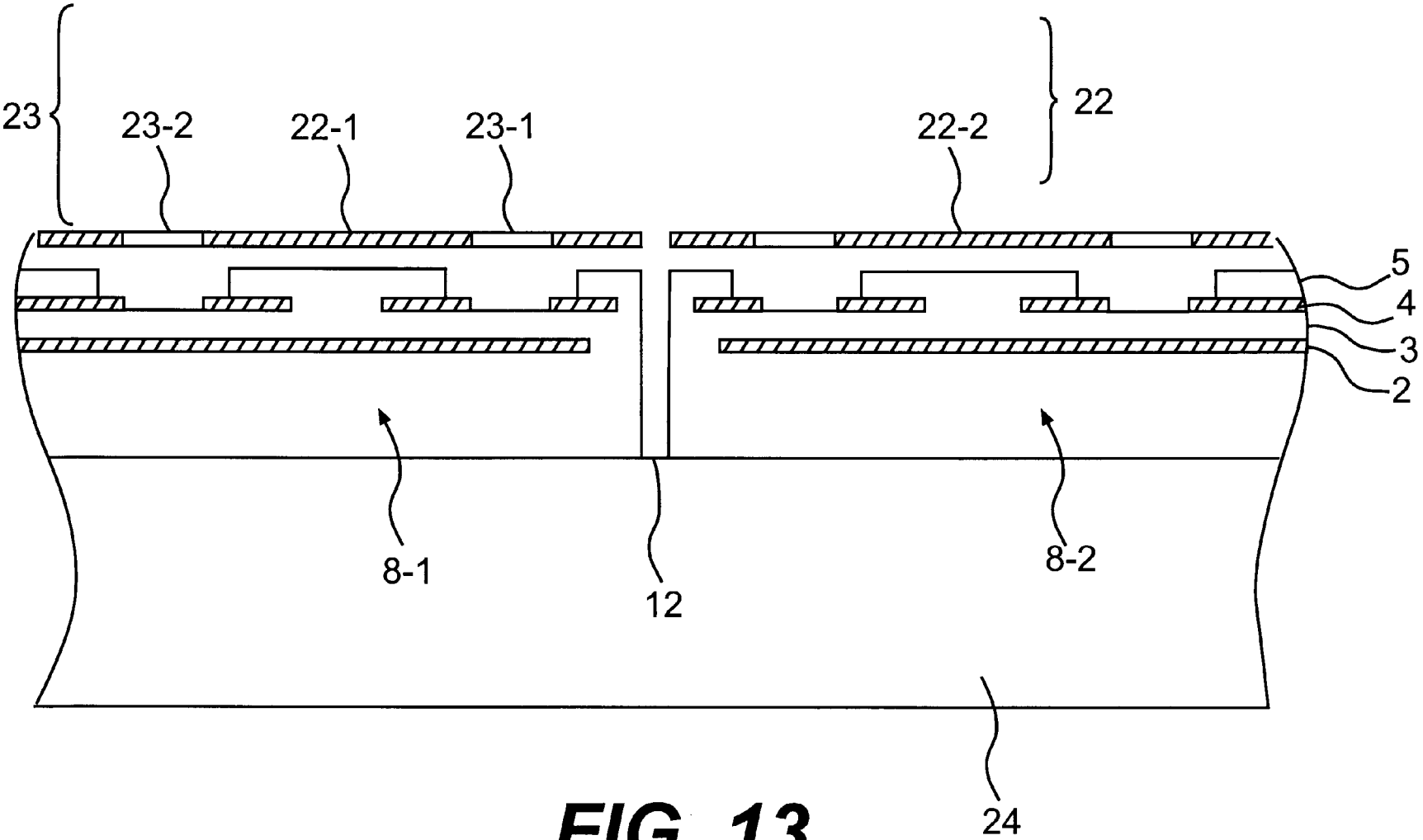
FIG. 13 is a partial cross-sectional view of the recording head along the line X5–X6 in FIG. 12.

FIG. 12 shows an example where two short recording heads 8-1 and 8-2 are disposed abutting each other on the common support substrate 24, and screen electrodes 22-1 and 22-2 are stuck to the short recording heads 8-1 and 8-2 respectively to form one recording head. The screen electrodes 22-1 and 22-2 are formed, for example, by making a plurality of apertures of 150 $\mu$m diameter 23-1, 23-2, and so forth, by photoetching on a stainless steel plate of 30 $\mu$m thickness. FIG. 13 shows the recording head cut along X5–X6 in FIG. 12, where the spacings between the screen electrodes 22-1 and 22-2 and the short recording heads 8-1 and 8-2 are maintained constant by a spacer not shown in the figure. Of course the screen electrodes 22-1 and 22-2 may be supported by a spacer formed immediately on the upper insulating layer 4, or held on the upper insulating layer 4.

Figure 14:
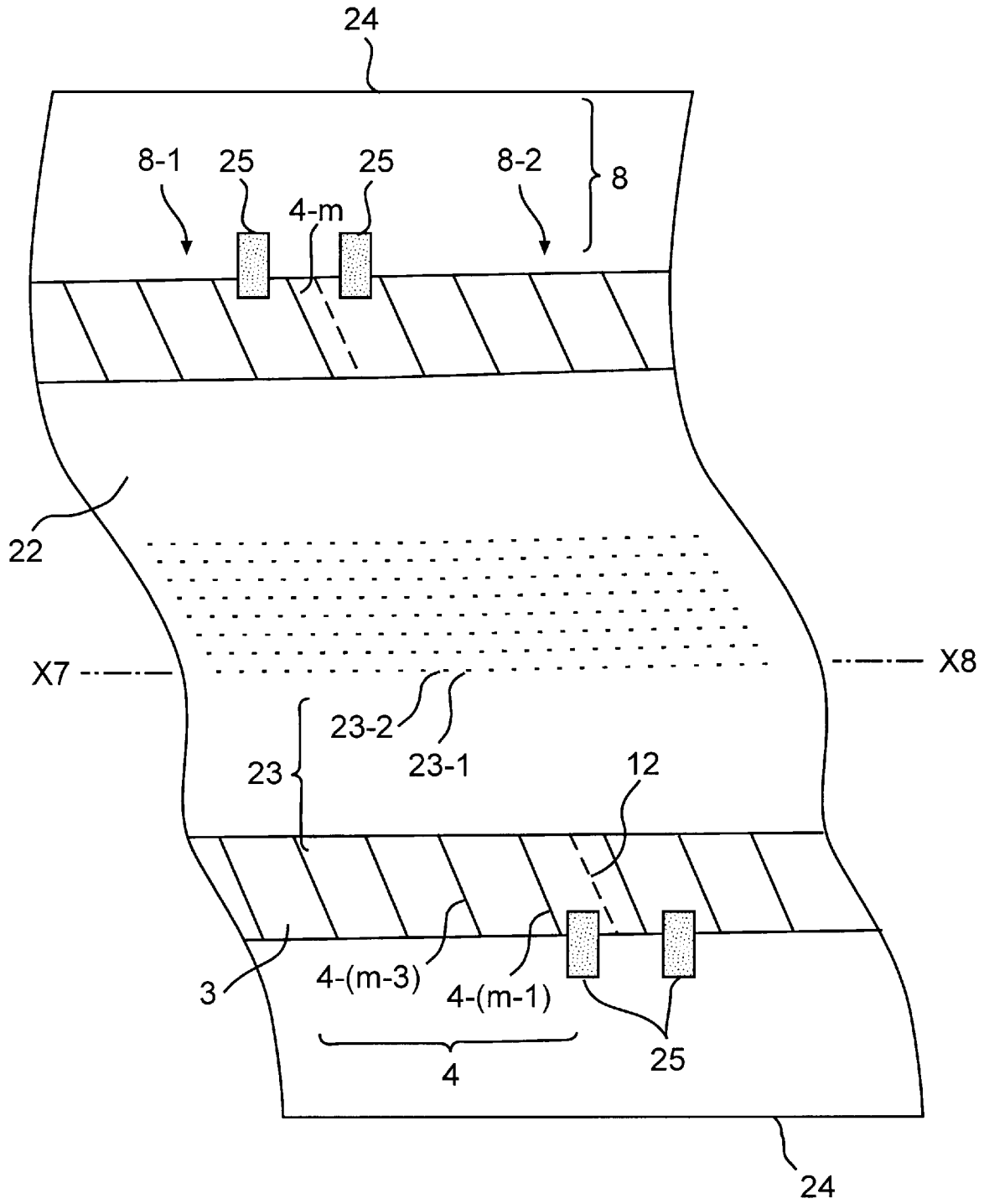
FIG. 14 is a partial plan view showing a recording head using a common screen electrode.
Figure 15:
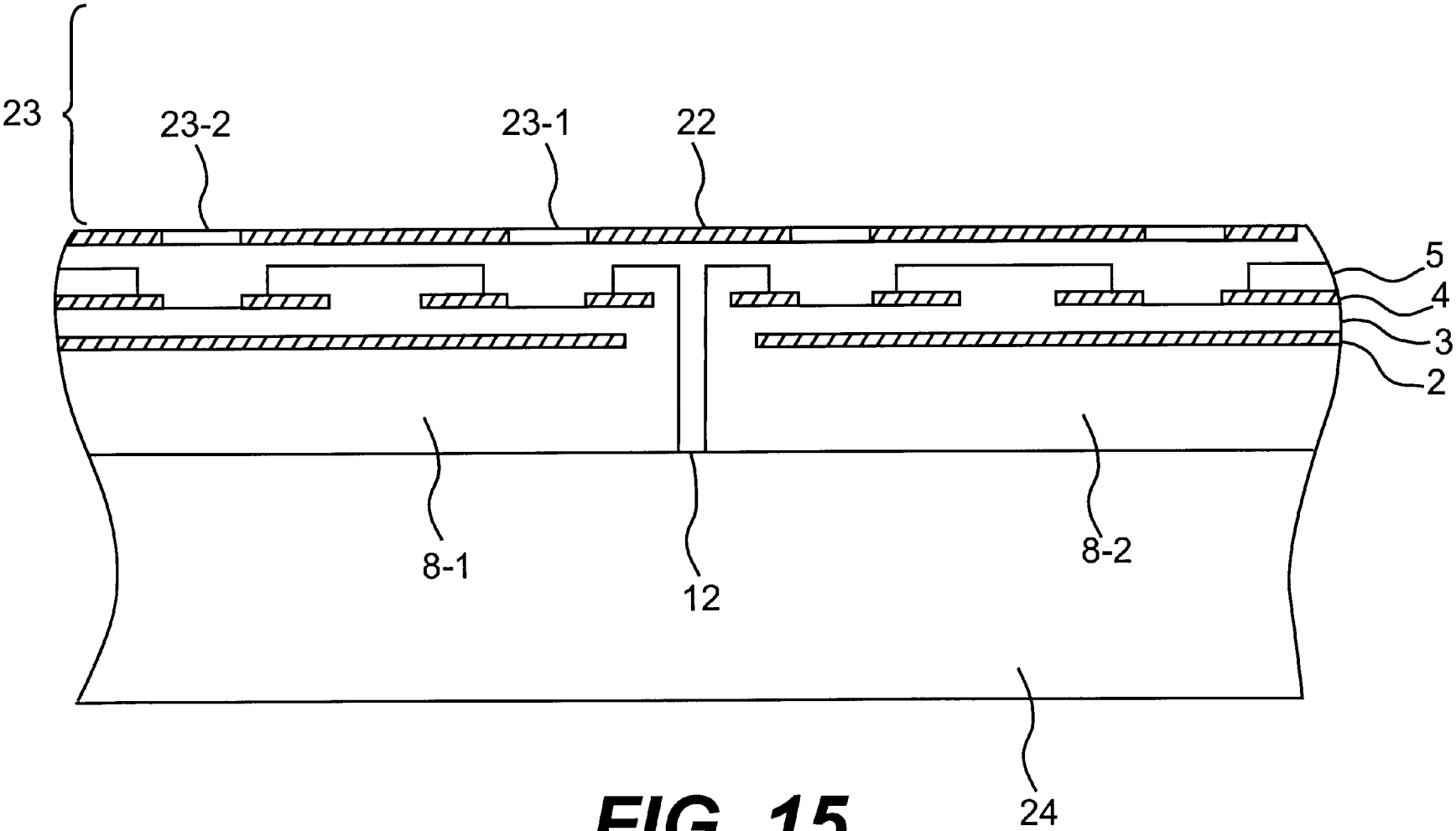
FIG. 15 is a partial cross-sectional view of the recording head along the line X7–X8 in FIG. 14.
Figure 16:
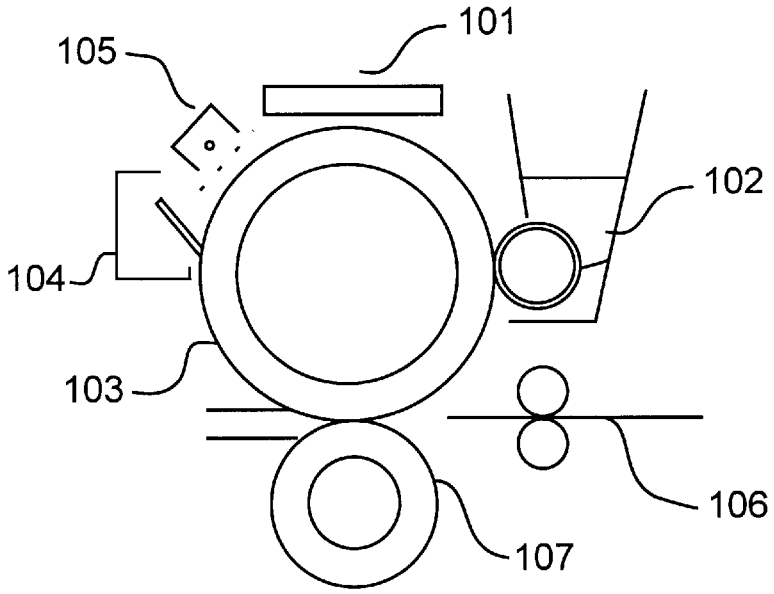
FIG. 16 is a schematic cross-sectional view showing the construction of an electrostatic recording apparatus.
Figure 17:
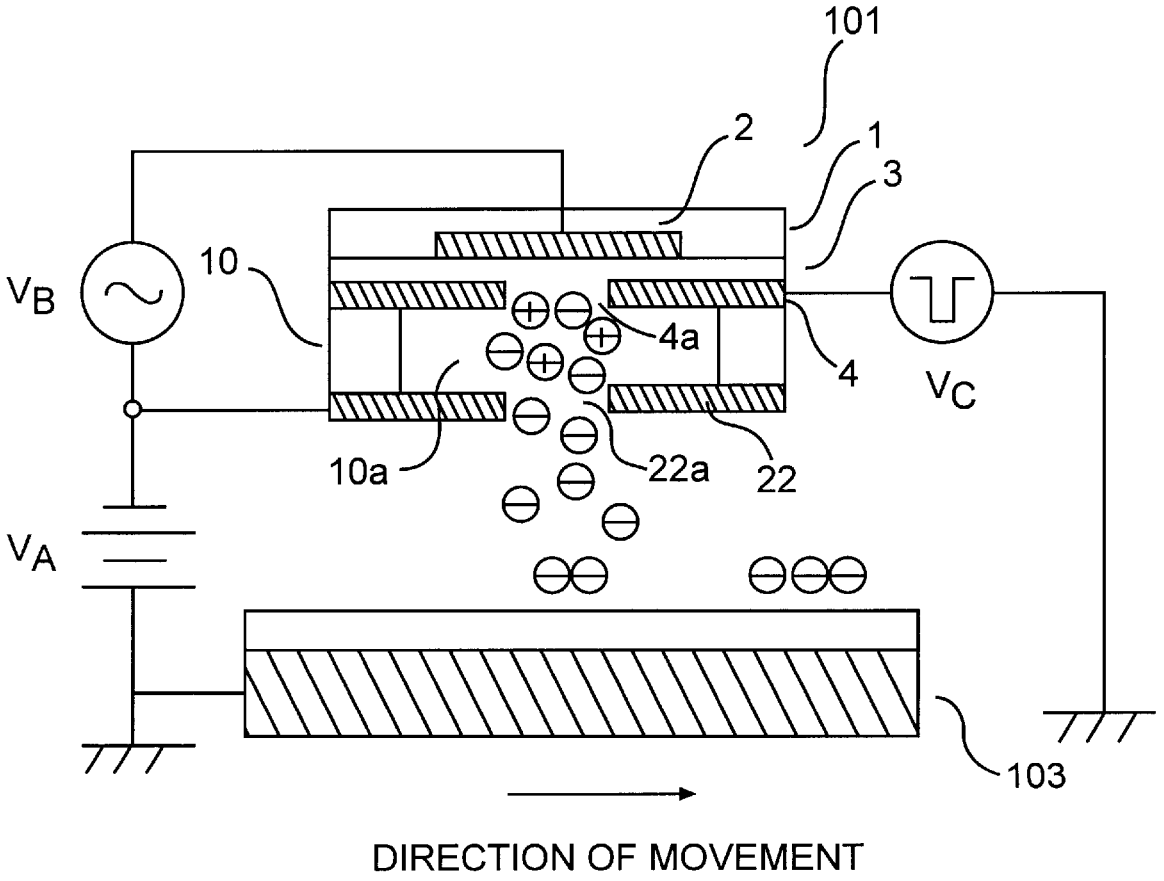
FIG. 17 is a cross-sectional view showing an ion emission port of the recording head for one picture element.

If the screen electrodes are installed as shown in FIGS. 12 and 13, since the screen electrodes 22-1 and 22-2 are independent of each other, the screen electrodes may occasionally be vibrated or twisted by the influence of an electric field of certain strength. An example improvement shown in FIGS. 14 and 15 uses an integral screen electrode which is stuck to the integral head which has been formed in advance by two short recording head bodies. FIG. 15 shows a section along line X7–X8 of the recording head in FIG. 14. According to this construction, no vibration, twisting or bending of the screen electrodes occurs, and moreover, discrepancies in the pixel spacings at the abutting portion are corrected because the pixel spacings are determined corresponding to the apertures 23-1, 23-2 and so forth in the screen electrode 22.

As described above, one aspect of the present invention enables the recording head to be manufactured by joining a plurality of short recording heads which are integrally formed by firing and are sufficiently small to ensure exact dimensions, which results in a reduction of the effects of firing contraction and provides a high performance recording head.

Moreover, another aspect of the present invention prevents an offset from occurring between the positions of the apertures in the screen electrodes and ion generating space; this therefore provides a high quality recorded image in which there is no reduction in the density of the recorded image, or image defects such as unevenness or blur.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method for manufacturing a recording head for electrostatic recording having a plurality of lower electrodes and upper electrodes constituting a matrix with an insulating layer interposed therebetween and causing corona discharge by applying a voltage between the lower and upper electrodes, comprising the steps of:

printing said lower electrodes on a substrate except for both end portions in the longitudinal direction;

printing said insulating layer on said lower electrodes;

printing said upper electrodes on said insulating layer;

forming a plurality of short partial recording heads and integrating said laminated lower electrodes, insulating layer and upper electrodes by firing;

forming cut-off portions at both ends of said plurality of short partial recording heads;

removing both cut-off portions in the longitudinal direction of said short partial recording heads where said lower and upper electrodes and insulating layer are not printed, thereby providing cut ends on said short partial recording heads; and joining said short partial recording heads at the cut ends to provide a recording head of a desired length.

2. A method for manufacturing a recording head for electrostatic recording according to claim 1 wherein:

the lower and upper electrodes have surfaces, and at least one of the cut ends is approximately perpendicular to the surfaces of said lower and upper electrodes.

3. A method for manufacturing a recording head for electrostatic recording having a space for ion generation to discharge ions formed by spaced lower electrodes and upper electrodes on a substrate with an insulating layer interposed therebetween comprising the steps of:

forming a laminate construction composed of said lower electrodes, insulating layer and upper electrodes on said substrate with a predetermined spacing from an edge of said substrate;

firing said substrate and laminate construction; and removing an edge portion of said substrate after firing, thereby to provide a short, partial recording head to be joined to at least one other such partial recording head to form a recording head of a desired length.

* * * * *

UNITED STATES PATENT AND TRADEMARK OFFICE

CERTIFICATE OF CORRECTION

PATENT NO. : 5,933,948
DATED : August 10, 1999
INVENTOR(S) : Suemitsu et al.

It is certified that error appears in the above-identified patent and that said Letters Patent is hereby corrected as shown below:

Title Page, Item [57], delete the Abstract in its entirety and insert therefor:

--A recording head for electrostatic recording having a plurality of lower electrodes and a plurality of upper electrodes constituting a matrix with an insulating layer interposed therebetween and a space for ion generation where corona discharge is caused by applying a voltage between the lower and upper electrodes, characterized in that a plurality of short partial recording heads are integrated by firing the lower electrodes, insulating layer and upper electrodes, and are joined to provide a recording head of a desired length. A method for manufacturing the recording head includes the steps of printing the lower electrodes on a substrate except for both end portions in the longitudinal direction, printing the insulating layer on the lower electrodes, printing upper electrodes on the insulating layer, forming a plurality of short partial recording heads by integrating the laminated lower electrodes by firing, insulating layer and upper electrodes, forming cut portions at both ends of a cut end line of the plurality of short partial recording heads, removing both end portions in the longitudinal direction of the short partial recording heads where the lower and upper electrodes and insulating layer are not printed, and joining the short partial recording heads at their cut ends to provide a recording head of a desired length.--.

UNITED STATES PATENT AND TRADEMARK OFFICE

CERTIFICATE OF CORRECTION

PATENT NO. : 5,933,948
DATED : August 10, 1999
INVENTOR(S) : Suemitsu et al.

It is certified that error appears in the above-identified patent and that said Letters Patent is hereby corrected as shown below:

Claim 2, column 8, line 47 after "claim 1", insert --,--.

Signed and Sealed this

Sixteenth Day of May, 2000

*Attest:*

Q. TODD DICKINSON

*Attesting Officer*

*Director of Patents and Trademarks*